US006186031B1

(12) United States Patent
Shiao

(10) Patent No.: US 6,186,031 B1
(45) Date of Patent: Feb. 13, 2001

(54) RATCHET ASSEMBLY FOR A SCREWDRIVER

(76) Inventor: Hsuan-Sen Shiao, No. 15-1, Lane 369, Min-Chuan Rd., Taichung City (TW)

( * ) Notice: Under 35 U.S.C. 154(b), the term of this patent shall be extended for 0 days.

(21) Appl. No.: 09/414,811

(22) Filed: Oct. 8, 1999

(51) Int. Cl.[7] ..... B25B 13/46
(52) U.S. Cl. ..... 81/63.1; 192/43.2
(58) Field of Search ..... 81/63.1, 58.3, 81/58.4, 60, 63.2; 192/43.2

(56) References Cited

U.S. PATENT DOCUMENTS 5,642,794 * 7/1997 Chuang et al. ..... 81/63.1 X
5,910,196 * 6/1999 Huang ..... 81/63.1 X

* cited by examiner

*Primary Examiner*—D. S. Meislin
(74) *Attorney, Agent, or Firm*—Foley & Lardner

(57) ABSTRACT

A ratchet assembly includes a housing having an actuator confining portion which extends axially and projects radially, which confines an actuator receiving space for receiving an actuator, and which is formed with an axially extending slot. A ratchet body is disposed rotatably in the housing, and has an outer surface provided with first and second ratchet wheels which are axially displaced from each other so as to define a slide portion therebetween. The actuator includes a curved plate, and first and second pawl members which project radially from the curved plate toward the ratchet body and which are disposed on opposite sides of a central line that extends through a central point of an arc length of the curved plate. An operating protrusion of the curved plate extends through the slot, and is operable to slide the actuator between a first uni-directional driving position, in which the first pawl member is slid into engagement with the first ratchet wheel and the second pawl member is slid out of engagement from the second ratchet wheel, and a second uni-directional driving position, in which the first pawl member is slid out of engagement from the first ratchet wheel and the second pawl member is slid into engagement with the second ratchet wheel.

7 Claims, 11 Drawing Sheets

RATCHET ASSEMBLY FOR A SCREWDRIVER

BACKGROUND OF THE INVENTION

1. Field of the Invention

This invention relates to a ratchet screwdriver, more particularly to a ratchet assembly of a ratchet screwdriver which has a relatively simple structure and which permits operation and replacement of tool bits mounted on two opposite ends of a drive shaft.

2. Description of the Related Art

FIG. 1 illustrates a first conventional ratchet screwdriver which has a hollow handle 10 formed with an axial receiving chamber 11 with open front and rear ends. An inner coupling sleeve 12 is received in the axial receiving chamber 11 adjacent to the rear end, while an outer coupling sleeve 13 is extended into the axial receiving chamber 11 and is disposed at the front end. The inner coupling sleeve 12 has a first section confining a rectangular hole portion 122 with a rectangular cross-section, and a second section confining a hexagonal hole portion 121 which has a hexagonal cross-section and which is connected to the rectangular hole portion 122. The outer coupling sleeve 13 confines an axial hole 131. A ratchet assembly 15 is mounted on the rear end of the handle 10, and has one end provided with a drive projection 151 which has a rectangular cross-section and which engages the rectangular hole portion 122, and the other end provided with a turning wheel 152 which extends out of the handle 10. A drive shaft 16 is extended through the axial hole 131 and into the axial receiving chamber 11 of the handle 10, and is retained in the axial hole 131 by an annular spring 132 provided on an inner surface of the outer coupling sleeve 13. The drive shaft 16 has two opposite ends, each of which engages a tool bit 161 that has a shank portion with a hexagonal cross-section. The shank portion of one of the tool bits 161 extends into the hexagonal hole portion 121 in the inner coupling sleeve 12, and engages non-rotatably the inner coupling sleeve 12. When the handle 10 is rotated in a certain direction, since the drive projection 151 engages the inner coupling sleeve 12, the inner coupling sleeve 12 engages one of the tool bits 161, and said one of the tool bits 161 engages the drive shaft 16, the drive shaft 16 is rotated axially to cause rotation of another one of the tool bits 161 in order to operate a workpiece, such as a screw. However, when the screwdriver applies a forward driving force along the drive shaft 16 during operation, it is likely that the drive shaft 16 pushes the inner coupling sleeve 12 rearwardly so as to push the ratchet assembly 15 outwardly of the handle 10. In this situation, the inner coupling sleeve 12 and one of the tool bits 161 might be undesirably exposed to injure the user.

Referring to FIGS. 2 and 3, another conventional ratchet screwdriver is shown to include a handle 20 having a head portion 21 which is formed with an axial hole 217 with an open end, and a slot 211. An actuator 221 and a pair of pawl plates 222 are disposed in the slot 211. A tubular housing 23 is sleeved around the headportion 21, and is formed with a circumferentially extending slot 231 to permit extension of an operating protrusion 223 of the actuator 221 therethrough. A drive shaft 24 is extended into the axial hole 217 in the head portion 21. The drive shaft 24 has two opposite ends formed with an axial blind hole 243 for engaging tool bits 25, and an intermediate portion formed as a ratchet wheel 241. A pair of annular retaining grooves 242 are formed on opposite sides of the ratchet wheel 241 for engaging ball members 215 which are mounted on the head portion 21 and which are biased radially and inwardly by means of springs 216 to engage the annular groove 242, thereby retaining the drive shaft 24 on the head portion 21. As shown, the actuator 221 is operable to move in a direction transverse to an axis of the drive shaft 24 to engage a selected one of the pawl plates 222 with the ratchet wheel 241 such that the drive shaft 24 can be driven by rotating the handle 20 in a certain direction.

However, this kind of ratchet screwdriver suffers from the following drawback: When the drive shaft 24 is inserted into the axial hole 217 of the handle 20, the pawl plates 222 will be pushed by an end wall of the drive shaft 24. In the case the drive shaft 24 is frequently inserted into and removed from the handle 20 for replacement of the tool bits 25, the pawl plates 222 are susceptible to deformation and displacement, thereby affecting adversely the engagement between the pawl plates 222 and the ratchet wheel 241.

SUMMARY OF THE INVENTION

Therefore, the object of the present invention is to provide a ratchet assembly for a hand tool which can solve the aforementioned problems.

Accordingly, the ratchet assembly according to the present invention includes a tubular housing, a cylindrical ratchet body, an actuator and a biasing member. The tubular housing is adapted to be mounted on a handle of the hand tool so as to be co-rotatable axially with the handle. The housing has a surrounding wall that has an actuator confining portion which extends axially and projects radially and which confines an actuator receiving space. The actuator confining portion is formed with an axially extending slot for access to the actuator receiving space. The ratchet body is disposed rotatably in the housing, and has an annular outer surface which is provided with a first ratchet wheel and a second ratchet wheel that is axially displaced from the first ratchet wheel so as to define a slide portion on the outer surface between the first and second ratchet wheels. The actuator is disposed in the actuator receiving space, and is slidable along the ratchet body. The actuator includes a curved plate having an arc length and a central line which extends through a central point of the arc length and along a direction parallel to an axis of the ratchet body. The actuator further includes first and second pawl members which project radially from the curved plate toward the outer surface of the ratchet body and which are disposed on opposite sides of the central line. The curved plate further has an operating protrusion extending through the slot in the housing. The operating protrusion is operable to slide along the slot so as to cause the actuator to slide along the ratchet body between a first uni-directional driving position, in which the first pawl member is slid into engagement with the first ratchet wheel and the second pawl member is slid out of engagement from the second ratchet wheel, and a second uni-directional driving position, in which the first pawl member is slid out of engagement from the first ratchet wheel and the second pawl member is slid into engagement with the second ratchet wheel. The biasing member is mounted in the housing for biasing the actuator to move in a radial inward direction toward the outer surface of the ratchet body. When the actuator is in the first uni-directional driving position, the first pawl member is pushed toward the first ratchet wheel when the housing is rotated axially in a first direction to permit co-rotation of the ratchet body and the housing in the first direction. The actuator is pushed radially and outwardly to disengage the first pawl member from the first ratchet wheel when the housing is rotated axially in a second direction opposite to the first direction, thereby preventing the ratchet body from rotating with the housing in the second direction. When the actuator is in the second uni-directional driving position, the second pawl member is pushed toward the second ratchet wheel when the housing is rotated axially in the second direction to permit co-rotation of the ratchet body and the housing in the second direction. The actuator is pushed radially and outwardly to disengage the second pawl member from the second ratchet wheel when the housing is rotated axially in the first direction, thereby preventing the ratchet body from rotating with the housing in the first direction.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
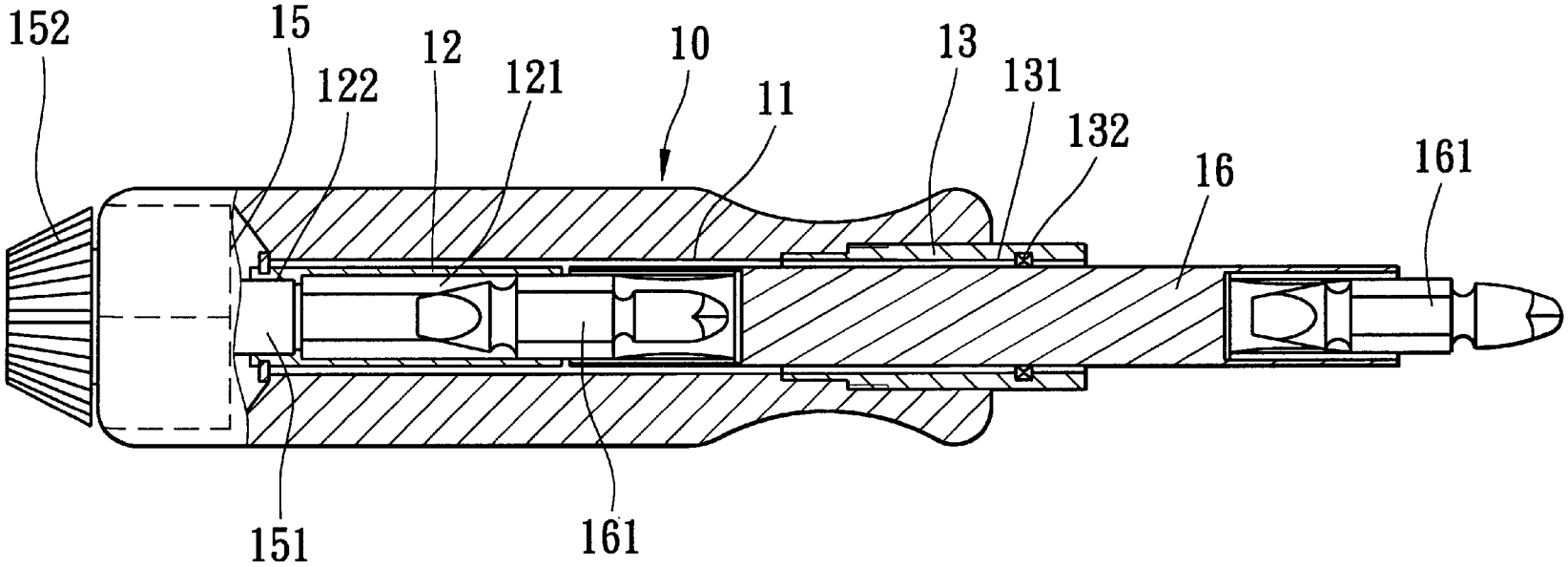
FIG. 1 PRIOR ART
FIG. 1 is a sectional view of a conventional ratchet screwdriver.
Figure 2:
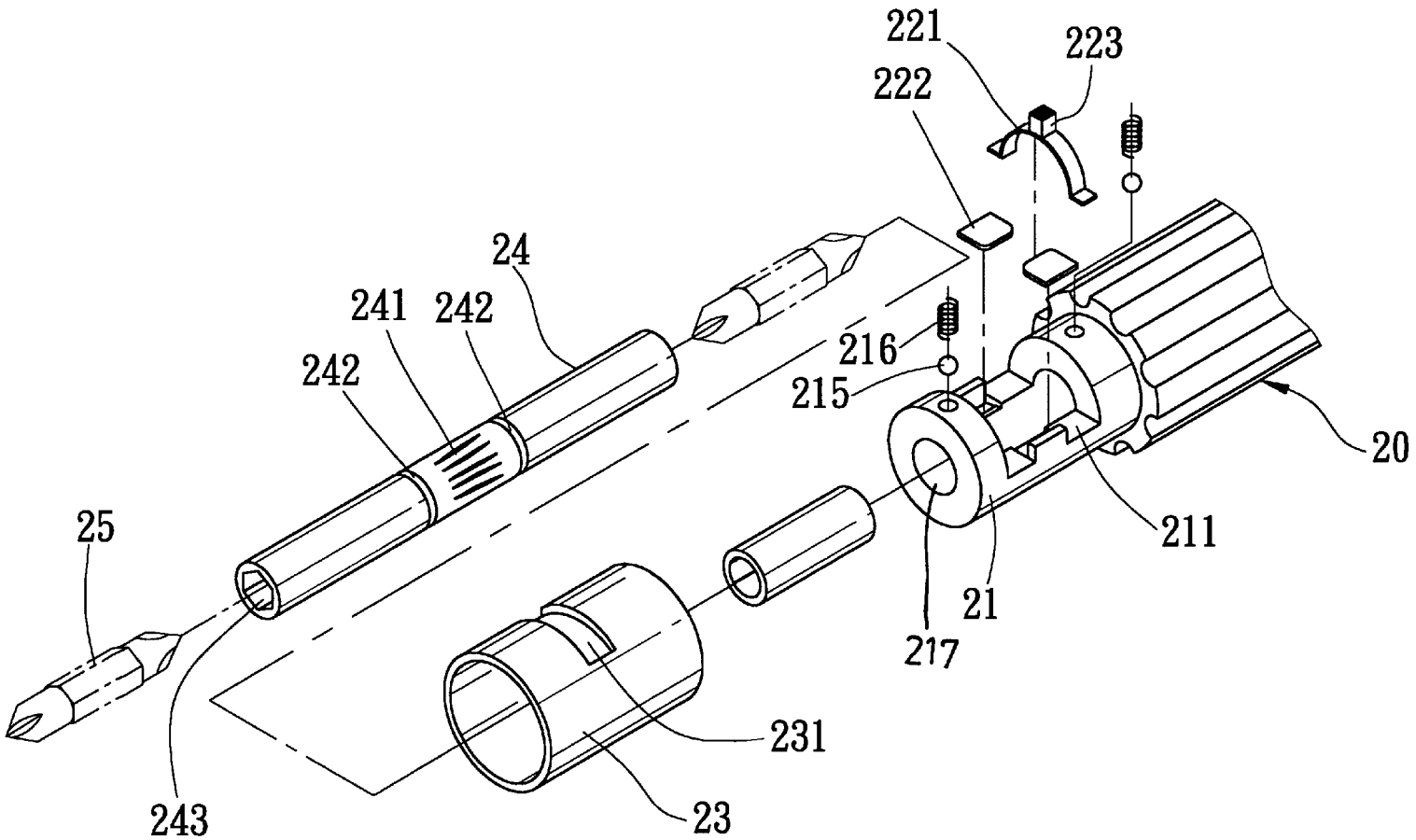
FIG. 2 PRIOR ART
FIG. 2 is an exploded perspective view of another conventional ratchet screwdriver.
Figure 3:
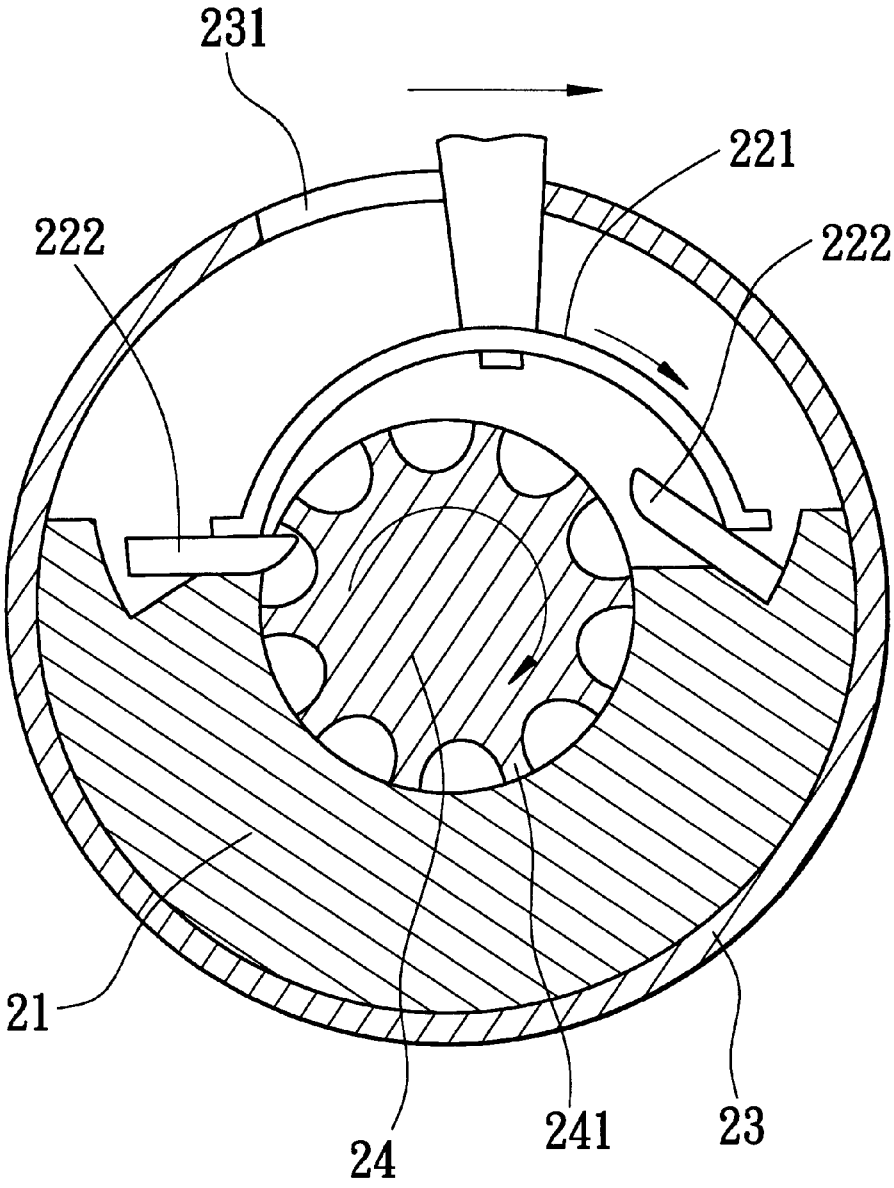
FIG. 3 PRIOR ART
FIG. 3 is a cross-sectional view of the ratchet screwdriver of FIG. 2.

Before the present invention is described in greater detail, it should be noted that like elements are denoted by the same reference numerals throughout the disclosure.

Figure 4:
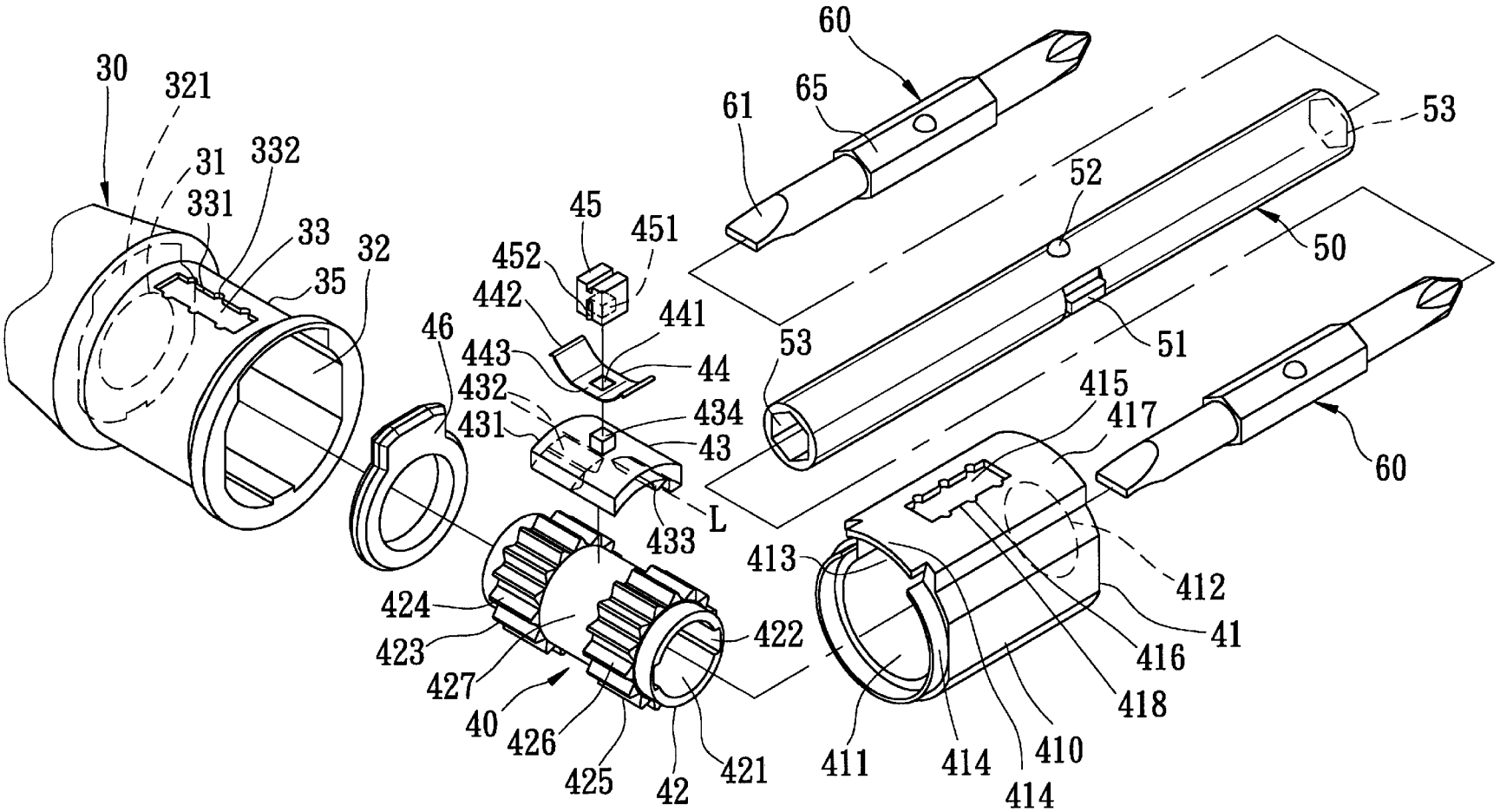
FIG. 4 is an exploded perspective view of a screwdriver incorporating a preferred embodiment of a ratchet assembly of the present invention.
Figure 5:
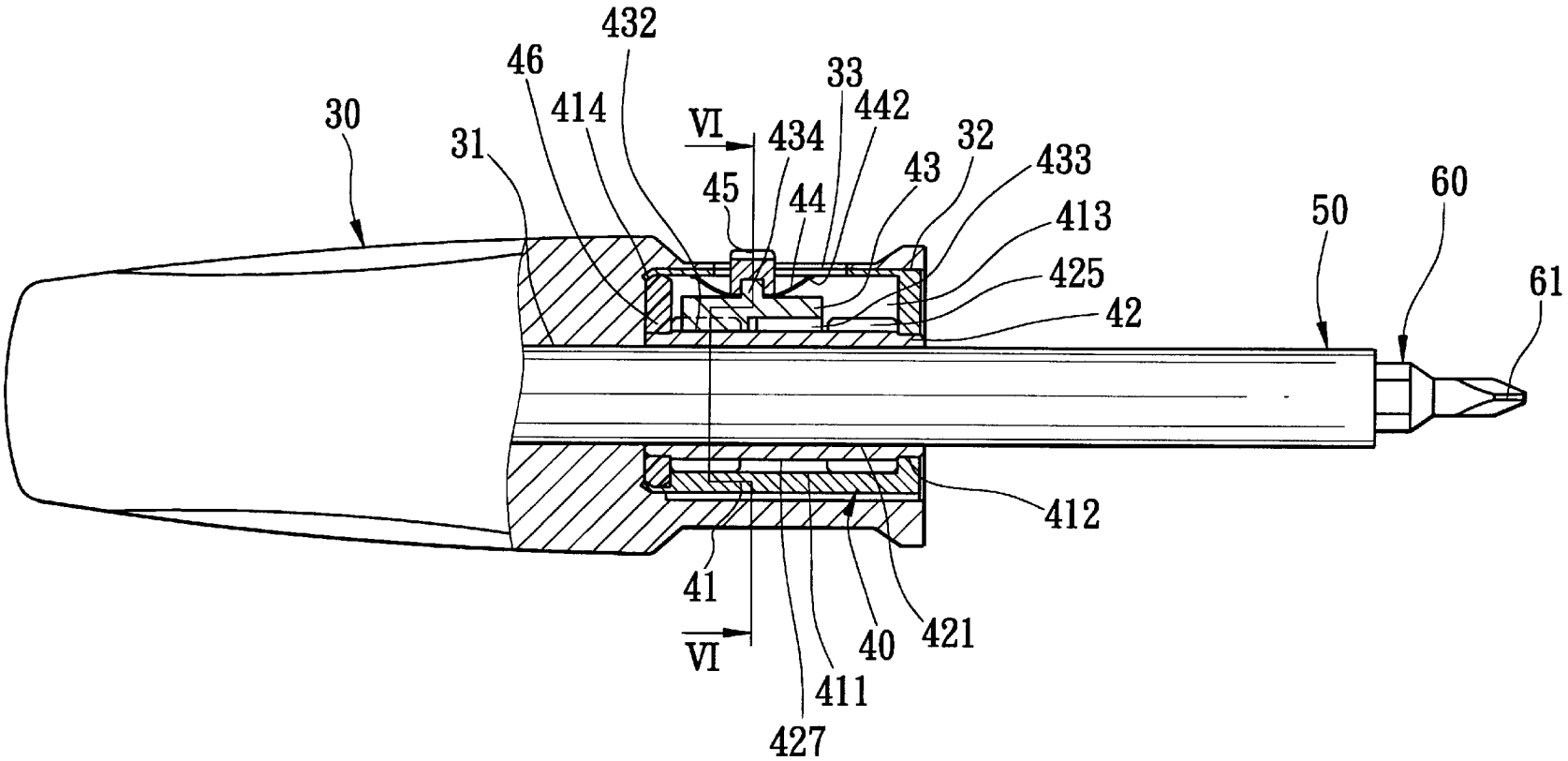
FIG. 5 is a partly sectional view of the screwdriver, where the ratchet assembly is in a first uni-directional driving state.

Referring to FIGS. 4 and 5, the preferred embodiment of the ratchet assembly 40 according to the present invention is shown to be applied to a ratchet screwdriver which includes a handle 30, a drive shaft 50 and a pair of tool bits 60.

The handle 30 has a tubular head portion 35 that confines a cavity 32 with a non-circular cross-section and an open end. The head portion 35 is formed with a generally rectangular and axially extending slot 33 that is communicated with the cavity 32. The slot 33 is defined by a pair of axially extending peripheral walls 331 which are formed with three aligned pairs of retaining grooves 332 axially displaced from one another. The cavity 32 is further communicated with an axial blind hole 31 in the handle 30. A shoulder 321 is defined between the cavity 32 and the axial blind hole 31.

The drive shaft 50 has two opposite ends formed with axial engaging holes 53 with a hexagonal cross-section, and an outer surface formed with a pair of key projections 51 (only one key projection 51 is shown) and a spring-loaded ball 52 that projects radially and resiliently from the outer surface.

Each of the tool bits 60 has an intermediate shank portion 65 with a hexagonal cross-section, and two bit portions 61 formed on two opposite ends of the shank portion 65. The tool bits 60 are inserted into the engaging holes 53 in the drive shaft 50 such that the shank portions 60 engage the engaging holes 53 to permit co-rotation of the tool bits 60 with the drive shaft 50. Preferably, the bit portions 61 of the tool bits 60 are designed to have different configurations for driving different types of workpieces.

The ratchet assembly 40 of the preferred embodiment is mounted in the cavity 32 of the handle 30, and is shown to include a tubular housing 41, a ratchet body 42, an actuator 43, and a biasing member 44.

The housing 41 has a shape complementing that of the cavity 32 in the handle 30, and is received fittingly in the cavity 32 so as to be co-rotatable axially with the handle 30. The housing 41 has a surrounding wall 410 with an actuator confining portion 417 that projects radially and extends axially and that confines an actuator receiving space 413 communicated with an axial receiving chamber 411 of the housing 41. The housing 41 has a first end formed with circumferentially extending retaining plates 414 which abut against the shoulder 321 in the handle 30, and an opposite second end formed with a circular axial opening 412 for access to the axial receiving chamber 411. The housing 41 further has a slot 415 defined by a pair of longitudinal peripheral walls 418, which are formed with three aligned pairs of retaining grooves 416 that are axially displaced from one another.

The ratchet body 42 is tubular in shape, and is received rotatably in the axial receiving chamber 411 of the housing 41. The ratchet body 42 has an inner surface that confines an axial hole 421 and a pair of diametrically opposite and axially extending keyways 422. The ratchet body 42 further has an annular outer surface formed with a first ratchet wheel 423 and a second ratchet wheel 425 that is axially displaced from the first ratchet wheel 423 so as to define a slide portion 427 on the outer surface between the first and second ratchet wheel 423, 425. Each of the ratchet wheels 423, 425 has a plurality of ratchet teeth 424, 426 arranged around the outer surface of the ratchet body 42. Each of the ratchet teeth 424, 426 has a triangular cross-section.

The actuator 43 is disposed in the actuator receiving space 413, and is slidable axially therein along the ratchet body 42. The actuator 43 includes a curved plate 431 which has an arc length and a central line (L) that extends through a central point of the arc length and along a direction parallel to an axis of the ratchet body 42. The actuator 43 further includes staggered first and second pawl members 432, 433 which are formed on opposite first and second axial end portions of the curved plate 431 and which are disposed on opposite lateral sides of the central line (L). Each of the first and second pawl members 432, 433 includes a pair of pawl projections which project radially from the curved plate 431 toward the outer surface of the ratchet body 40 and which have triangular cross-sections that complement the ratchet teeth 424, 426 of the first and second ratchet wheels 423, 425 of the ratchet body 42. The curved plate 431 has an operating protrusion 434 which projects radially and outwardly from the curved plate 431.

The biasing member 44 is formed as a curved and resilient spring plate, and is disposed between the curved plate 431 and the actuator confining portion 417 of the surrounding wall 410 of the housing 41. The biasing member 44 has two opposite ends 442 abutting against an inner surface of the actuator confining portion 417, and an intermediate portion 443 formed with a through hole 441 to permit extension of the operating protrusion 434 therethrough such that the intermediate portion 443 abuts against the curved plate 431. The biasing member 44 biases the actuator 43 to move in a radial inward direction toward the ratchet body 42. A knob 45 is provided on the operating protrusion 434, and has an engaging hole 451 which engages the operating protrusion 434. The knob 45 extends outwardly of the slots 415, 33 to permit operation thereof. The knob 45 has two opposite ribs 452 for engaging the engaging grooves 416, 332 in the slots 415, 33. An annular stop plate 46 formed of a rigid plastic material is sleeved on the ratchet body 42 adjacent to the first ratchet wheel 424, and is disposed in the first end of the housing 41. The retaining plates 414 formed on the first end of the housing 41 are bent inwardly after the ratchet body 42 and the stop plate 46 are received in the housing 41 so as to prevent removal of the stop plate 46 and the ratchet body 42 from the housing 41 via the first end of the housing 41. The axial hole 412 formed in the second end of the housing 412 has a size sufficient to prevent removal of the ratchet body 42 therefrom. The ratchet body 42 is thus retained in the housing 41, and is rotatable in the axial receiving chamber 411 relative to the housing 41.

During assembly, the ratchet assembly 40 is received in the cavity 32 of the handle 30 such that the retaining plates 414 on the first end of the housing 41 abut against the shoulder 321 in the handle 30 and such that the knob 45 extends out of the slit 33 in the head portion 35 of the handle 30 to permit operation of the ratchet assembly 40 by operating the knob 45. The tool bits 60 are inserted into the engaging holes 53 in the drive shaft 50 for co-rotation with the drive shaft 50. Then, the bit-holding drive shaft 50 is extended through the axial hole 42 in the ratchet body 42 and into the blind hole 31 in the handle 30 such that the key projections 51 of the drive shaft 50 engage the keyways 422 in the ratchet body 42 to permit co-rotation of the drive shaft 50 with the ratchet body 42.

Figure 6:
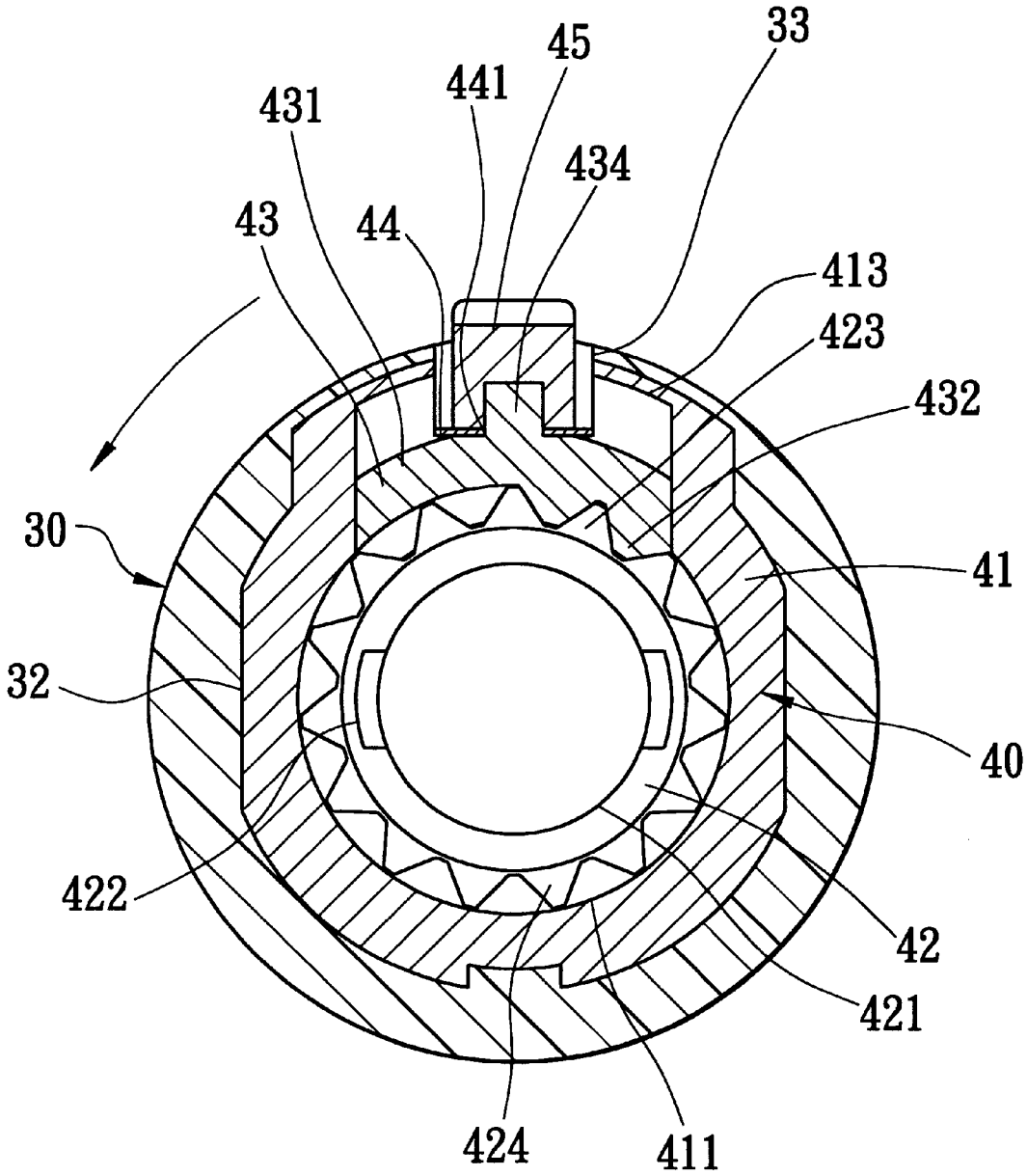
FIG. 6 is a cross-sectional view of the screwdriver, taken along line VI—VI of FIG. 5.
Figure 7:
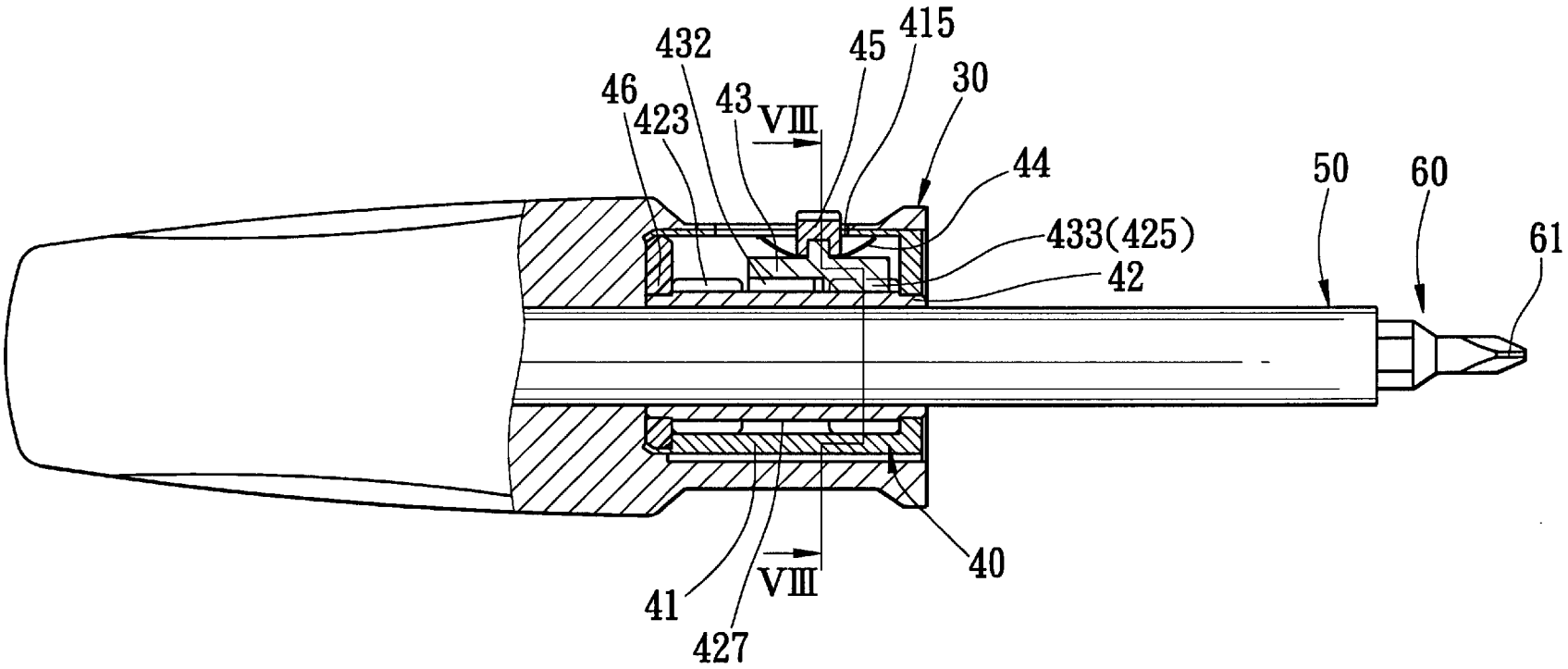
FIG. 7 is a partly sectional view of the screwdriver, where the ratchet assembly is in a second uni-directional driving state.
Figure 8:
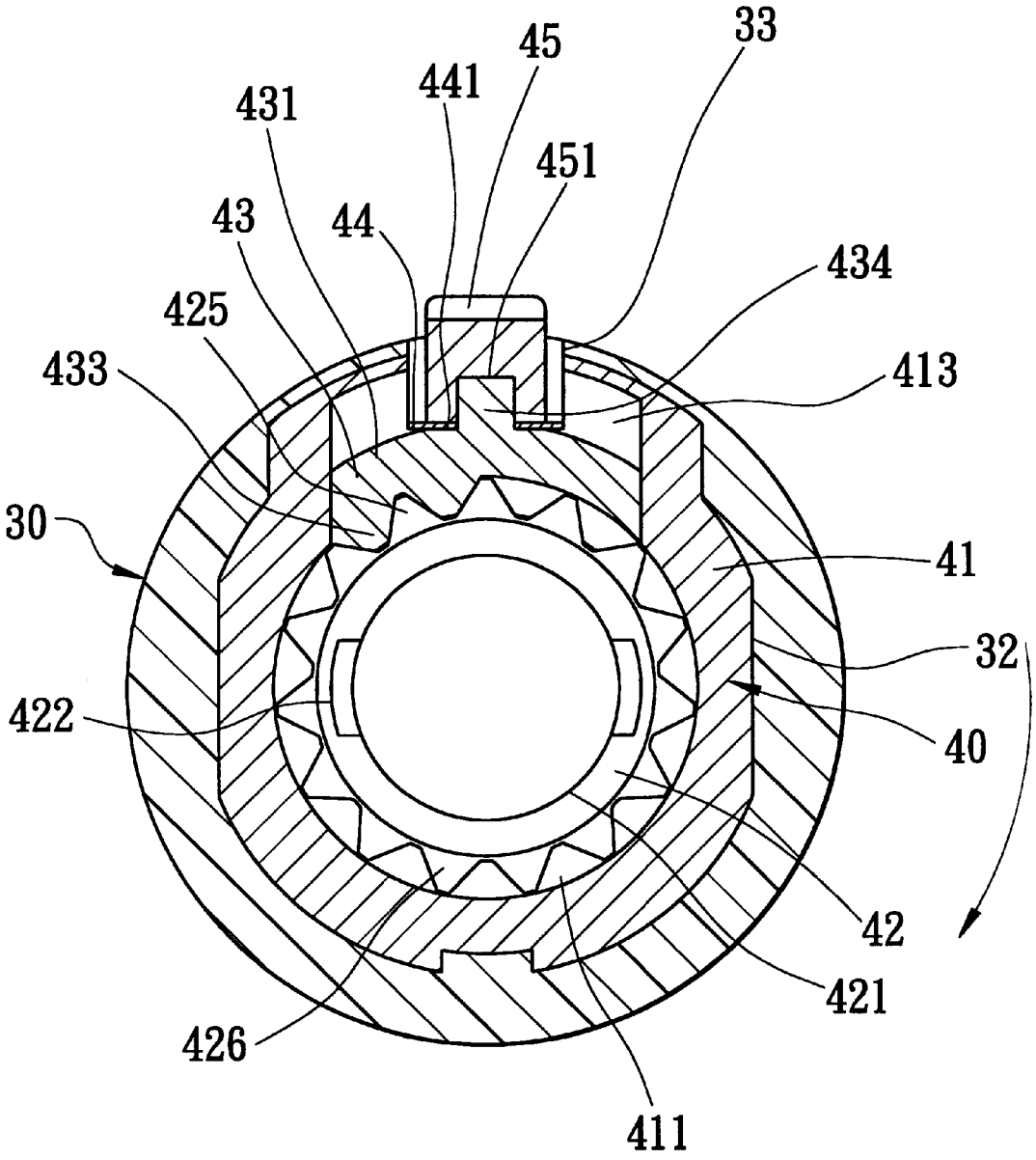
FIG. 8 is a cross-sectional view of the screwdriver, taken along line VIII—VIII of FIG. 7.
Figure 9:
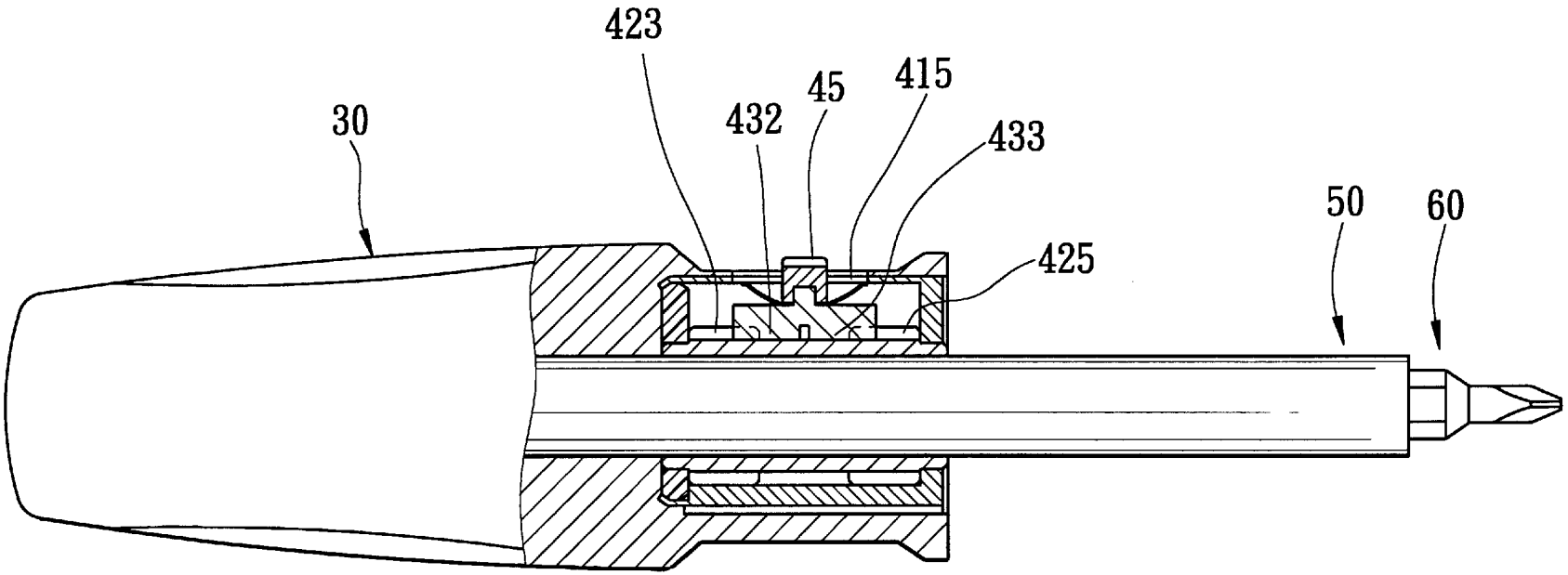
FIG. 9 is a partly sectional view of the screwdriver, where the ratchet assembly is in a bi-directional driving state.

In use, the knob 45 is operable to slide along the slots 415, 33 so as to cause the actuator 43 to slide axially in the actuator receiving space 413 and along the ratchet body 42 among a first uni-directional driving position shown in FIGS. 5 and 6, in which the first pawl member 432 is slid into engagement with the first ratchet wheel 423, while the second pawl member 433 is slid out of engagement from the second ratchet wheel 425 and is registered with the slide portion 427 of the ratchet body 42, a second uni-directional driving position shown in FIGS. 7 and 8, in which the second pawl member 433 is slid into engagement with the second ratchet wheel 425 while the first pawl member 432 is slid out of engagement from the first ratchet wheel 423 and is registered with the slide portion 427 of the ratchet body 42, and a bi-directional driving position shown in FIG. 9, in which the first pawl member 432 is slid into engagement with the first ratchet wheel 423 and the second pawl member 433 is slid into engagement with the second ratchet wheel 425. Referring again to FIG. 4, when the actuator 43 is in any of the first and second uni-directional driving positions and the bi-directional driving position, the ribs 452 of the knob 45 engage a corresponding pair of the retaining grooves 416 in the slits 33, 415 for retaining the actuator 43 in said position.

FIGS. 5 and 6 illustrate the state when the actuator 43 is in the first uni-directional driving position. In this state, when the handle 30 is rotated counter-clockwise to cause corresponding counter-clockwise rotation of the housing 41 and the actuator 43 together with the handle 30, the first pawl member 432 is pushed toward the first ratchet wheel 423 to transmit a rotary driving force to the ratchet body 42 and to permit co-rotation of the ratchet body 42 with the housing 41 and the handle 30. The drive shaft 50 and the tool bits 60 mounted thereon are thus rotated counter-clockwise to permit driving of a workpiece, such as a screw (not shown). On the other hand, when the handle 30 is rotated clockwise to cause corresponding clockwise rotation of the housing 41 and the actuator 43 together with the handle 30, the actuator 43 is pushed radially and outwardly against the biasing action of the biasing member 44 to disengage the first pawl member 432 from the first ratchet wheel 423, thereby preventing transmission of the rotary driving force to the ratchet body 42 and preventing the ratchet body 42 from rotating with the housing 41 and the handle 30. Idle rotation of the handle 30 and the housing 41 with respect to the ratchet body 42 and the drive shaft 50 thus results. During rotation of the handle 30 in the clockwise direction, the first pawl member 432 meshes with the first ratchet wheel 423 intermittently due to the biasing force applied by the actuator 43.

FIGS. 7 and 8 illustrate the state when the actuator 43 is slid axially in a direction toward the drive shaft 50 to the second uni-directional driving position. In this state, when the handle 30 is rotated clockwise to cause corresponding clockwise rotation of the housing 41 and the actuator 43 together with the handle 30, the second pawl member 433 is pushed toward the second ratchet wheel 425 to transmit a rotary driving force to the ratchet body 42 and to permit co-rotation of the ratchet body 42 with the housing 41 and the handle 30. The drive shaft 50 and the tool bits 60 thereon are thus rotated clockwise for driving a workpiece. On the other hand, when the handle 30 is rotated counter-clockwise to cause corresponding counter-clockwise rotation of the housing 41 and the actuator 43 together with the handle 30, the actuator 43 is pushed radially and outwardly against the biasing action of the biasing member 44 to disengage the second pawl member 433 from the second ratchet wheel 425, thereby preventing transmission of the rotary driving force to the ratchet body 42 and preventing the ratchet body 42 from rotating with the housing 41 and with the handle 30. Idle rotation of the handle 30 and the housing 41 with respect to the ratchet body 42 and the drive shaft 50 thus results. Similarly, during rotation of the handle 30 in the counter-clockwise direction, the second pawl member 433 meshes with the second ratchet wheel 425 intermittently due to the biasing force applied by the actuator 43.

Referring to FIG. 9, when the actuator 43 is slid to the bi-directional driving position, since the first and second pawl members 432, 433 engage the first and second ratchet wheels 423, respectively, the ratchet body 42 and the drive shaft 50 are co-rotatable with the housing 41 and the handle 30 when the handle 30 is rotated in either the clockwise direction or the counter-clockwise direction.

When it is desired to replace the tool bits 60, the drive shaft 50 is simply removed from the axial hole 421 of the ratchet body 42, without affecting the state and relative positions of the components of the ratchet assembly 40. In the ratchet screwdriver illustrated above, a total number of four bit portions 61 are available.

Figure 10:
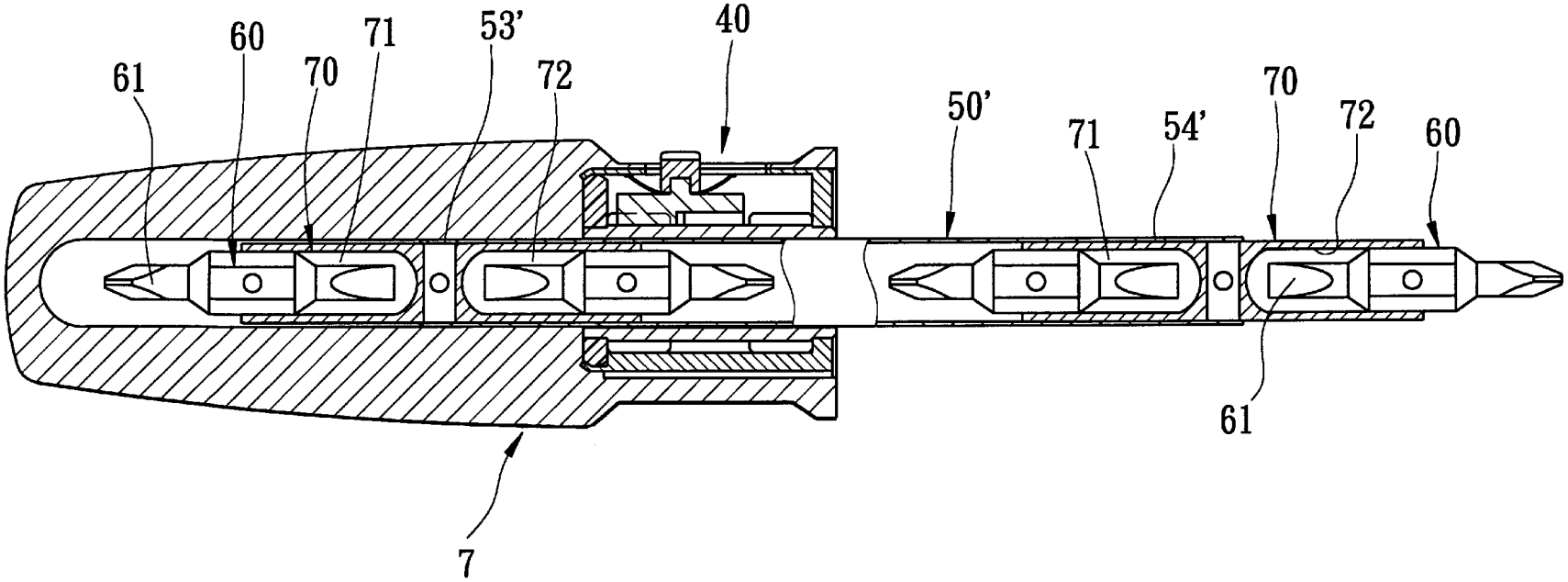
FIG. 10 is a cross-sectional view of another screwdriver which incorporates the ratchet assembly of the preferred embodiment.

FIG. 10 illustrates another ratchet screwdriver 7 incorporating the ratchet assembly 40 of the preferred embodiment.

As shown, two tubular sleeves 70 are inserted into two opposite ends 53, 54 of the drive shaft 50', respectively, for engaging non-rotatably the drive shaft 50'. Each of the tubular sleeves 70 has two opposite axial holes 71, 72 with hexagonal cross-sections for engaging the tool bits 60, respectively. As such, a total number of eight bit portions 61 are available.

Figure 11:
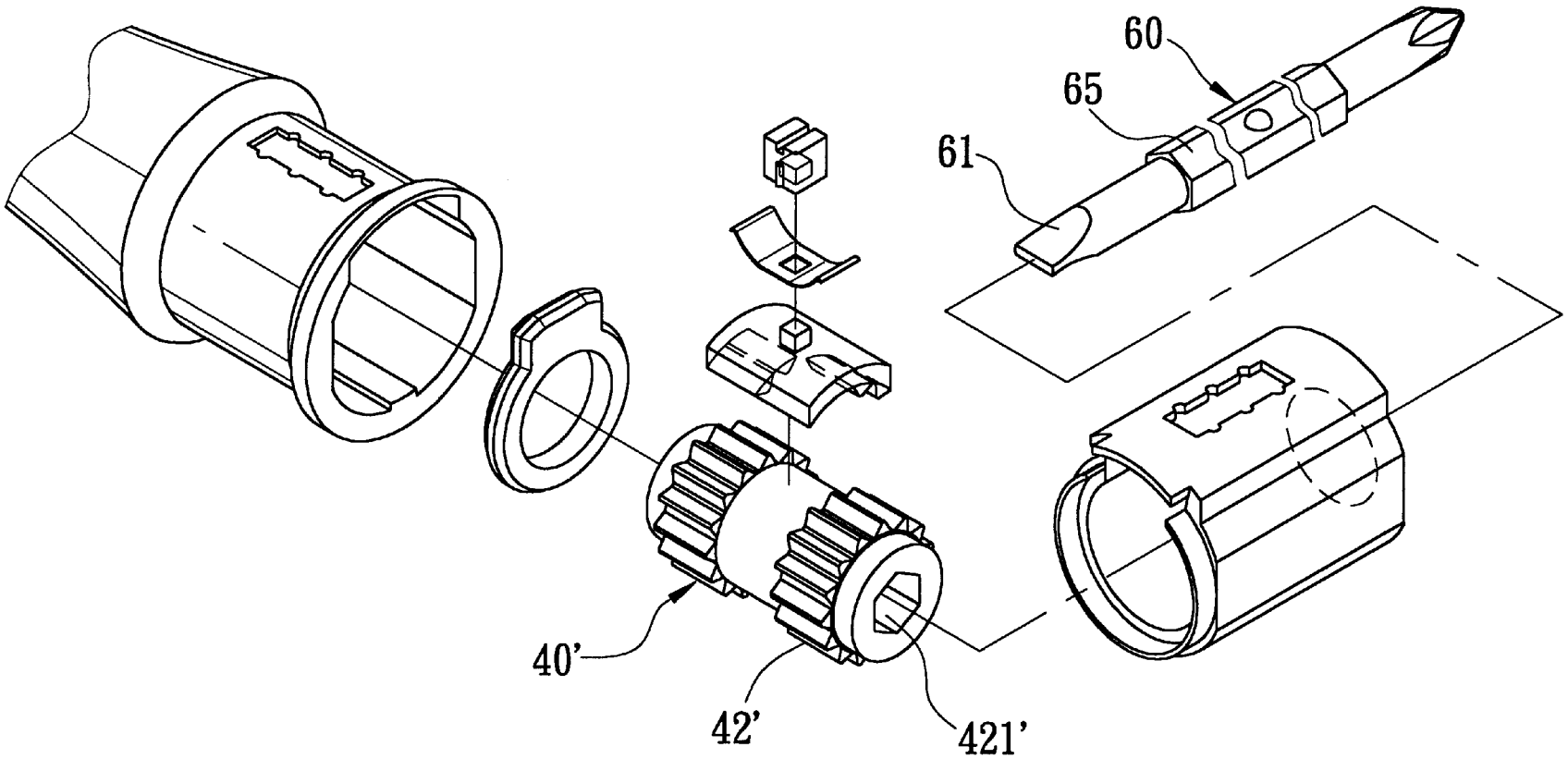
FIG. 11 is an exploded perspective view of another ratchet screwdriver which incorporates a modified preferred embodiment of the ratchet assembly of the present invention.

FIG. 11 illustrates a modified preferred embodiment of the ratchet assembly 40' of the present invention. The ratchet assembly 40' differs from the ratchet assembly 40 of the previous embodiment in that the axial hole 421' of the ratchet body 42' has a hexagonal cross-section for engaging the shank portion 65 of the tool bit 60 so as to mount the tool bit 60 directly on the ratchet body 42'.

It has been shown that, the ratchet assembly 40 of the present invention can be retained in the head portion 35 of the handle 30 during operation of the ratchet screwdriver without the risk of exposure from the handle 30 and injuring the user. In addition, since the drive shaft 50 is extended into the axial hole 421 in the ratchet body 42 and since the ratchet wheels 423, 425 are formed on the outer surface of the ratchet body 42, the components of the ratchet assembly 40 can be prevented from being displaced and deformed even though the drive shaft 50 is frequently inserted into and removed from the ratchet body 42 for replacement of the tool bits 60.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A ratchet assembly for a hand tool having a handle, comprising:

a tubular housing adapted to be mounted on the handle so as to be co-rotatable axially with the handle, said housing having a surrounding wall that has an actuator confining portion which extends axially and projects radially and which confines an actuator receiving space, said actuator confining portion being formed with an axially extending slot for access to said actuator receiving space;

a cylindrical ratchet body disposed rotatably in said housing and having an annular outer surface which is provided with a first ratchet wheel and a second ratchet wheel that is axially displaced from said first ratchet wheel so as to define a slide portion on said outer surface between said first and second ratchet wheels;

an actuator disposed in said actuator receiving space and slidable along said ratchet body, said actuator including a curved plate having an arc length and a central line which extends through a central point of said arc length and along a direction parallel to an axis of said ratchet body, said actuator further including first and second pawl members which project radially from said curved plate toward said outer surface of said ratchet body and which are disposed on opposite sides of said central line, said curved plate further having an operating protrusion extending through said slot in said housing, said operating protrusion being operable to slide along said slot so as to cause said actuator to slide along said ratchet body between a first uni-directional driving position, in which said first pawl member is slid into engagement with said first ratchet wheel and said second pawl member is slid out of engagement from said second ratchet wheel, and a second uni-directional driving position, in which said first pawl member is slid out of engagement from said first ratchet wheel and said second pawl member is slid into engagement with said second ratchet wheel; and a biasing member mounted in said housing for biasing said actuator to move in a radial inward direction toward said outer surface of said ratchet body;

when said actuator is in the first uni-directional driving position, said first pawl member being pushed toward said first ratchet wheel when said housing is rotated axially in a first direction to permit co-rotation of said ratchet body and said housing in the first direction, said actuator being pushed radially and outwardly to disengage said first pawl member from said first ratchet wheel when said housing is rotated axially in a second direction opposite to the first direction, thereby preventing said ratchet body from rotating with said housing in the second direction, when said actuator is in the second uni-directional driving position, said second pawl member being pushed toward said second ratchet wheel when said housing is rotated axially in the second direction to permit co-rotation of said ratchet body and said housing in the second direction, said actuator being pushed radially and outwardly to disengage said second pawl member from said second ratchet wheel when said housing is rotated axially in the first direction, thereby preventing said ratchet body from rotating with said housing in the first direction.

2. The ratchet assembly according to claim 1, wherein said operating protrusion of said actuator is operable to slide along said slot so as to cause said actuator to further slide along said ratchet body to a bi-directional driving position, in which said first and second pawl members are slid into engagement with said first and second ratchet wheels, respectively.

3. The ratchet assembly according to claim 1, wherein said biasing member includes a resilient spring plate disposed between said curved plate of said actuator and said actuator confining portion of said surrounding wall of said housing.

4. The ratchet assembly according to claim 3, wherein said resilient spring plate is curved, and has two opposite ends that abut against said actuator confining portion of said surrounding wall of said housing and an intermediate portion that abuts against said curved plate of said actuator.

5. The ratchet assembly according to claim 1, wherein said ratchet body is tubular in shape, and confines an axial hole adapted to engage non-rotatably a bit-holding drive shaft of the hand tool.

6. The ratchet assembly according to claim 5, wherein said ratchet body is formed with keyways in said axial hole for engaging key projections on the drive shaft.

7. The ratchet assembly according to claim 1, wherein said ratchet body is tubular in shape, and confines an axial hole with a polygonal cross-section so as to be adapted to engage a tool bit of the hand tool.

* * * * *